United States Patent [19]

Murakami et al.

[11] 4,050,929

[45] Sept. 27, 1977

[54] HEAT RESISTING ALLOYED STEEL

[75] Inventors: Shinichi Murakami, Osaka; Katsutaro Akamatsu; Toshiaki Morichika, both of Hirakata; Hisashi Hiraishi, Kyoto, all of Japan

[73] Assignee: Kubota, Ltd., Japan

[21] Appl. No.: 636,644

[22] Filed: Dec. 1, 1975

[51] Int. Cl.[2] ..... C22C 30/00

[52] U.S. Cl. ..... 75/171; 75/122; 75/134 F

[58] Field of Search ..... 75/171, 122, 134 F

[56] References Cited

U.S. PATENT DOCUMENTS

| | | | |
|---|---|---|---|
| 3,723,108 | 3/1973 | Twigg et al. | 75/171 |

FOREIGN PATENT DOCUMENTS

| | | | |
|---|---|---|---|
| 47-18332 | 5/1972 | Japan | 75/122 |
| 44-1825 | 1/1969 | Japan | 75/134 F |
| 46-32847 | 9/1971 | Japan | 75/134 F |
| 637,436 | 6/1946 | United Kingdom | 75/134 F |
| 674,023 | 6/1952 | United Kingdom | 75/171 |
| 710,413 | 6/1954 | United Kingdom | 75/171 |

OTHER PUBLICATIONS

"Metal Selector," 1963 Ed., p. 5-14.

"Journal of Metals" — Tours Aime, 9/53, pp. 1149-1150.

*Primary Examiner*—Arthur J. Steiner

*Attorney, Agent, or Firm*—Wenderoth, Lind & Ponack

[57] ABSTRACT

A heat resisting alloyed steel having a highly improved compressive strength at the elevated temperature within the range of 1,250° to 1,300° C. contains carbon, silicon, chromium, nickel, manganese, cobalt, molybdenum, phosphorus, sulfur, niobium and iron. Tungsten may be added as desired.

2 Claims, 2 Drawing Figures

HEAT RESISTING ALLOYED STEEL

BACKGROUND OF THE INVENTION

The present invention relates to a heat resisting alloyed steel and, more particularly, to a heat resisting alloyed steel capable of exhibiting a high compressive strength at elevated temperature.

The present invention pertains to the heat resisting alloyed steel which is suited as a material for rails or like guides installed on the hearth within a heating furnace and which can exhibit a high compressive strength at the elevated temperature within the range of from 1,250° to 1,300° C.

An alloyed steel, which contains, in addition to iron, 30% chromium and 50% cobalt as essential components thereof, is well known as having a high resistance to elevated temperature, for example, 1,250° to 1,300° C. Because of this physical property, this 30%C–50%Co-Fe alloyed steel has heretofore largely used as a material for rails or like guides installed on the hearth within a heating furnace. The rails prepared from this known alloyed steel have exhibited a practically acceptable durability even though subjected to the elevated temperature within the range of 1,250° to 1,300° C., but is not considered satisfactory for the following reason.

With reference to FIG. 1 of the accompanying drawings, an equilibrium diagram of alloyed steels containing iron, chromium and cobalt is shown as having isothermal lines exhibited at the temperature of 600° C. The composition of the alloyed steel containing 30% chromium, 50% cobalt and 20% iron is indicated by a point marked by *a*. As can be seen from the equilibrium diagram, the known alloyed steel used as a material for the rails represents a structure having a $\alpha$-Co phase and $\sigma$-phase. Because of instability in structure due to precipitation of the $\sigma$-phase, the known alloyed steel is susceptible to cracking when a load is imposed thereon.

SUMMARY OF THE INVENTION

Accordingly, an essential object of the present invention is to provide an improved heat resisting alloyed steel which exhibits a high compressive strength at elevated temperature, with substantial elimination of the disadvantage inherent in a known alloyed steel of similar kind.

Another important object of the present invention is to provide an improved heat resisting alloyed steel of the kind referred to above which also exhibit a sufficient hardness even as cast.

BRIEF DESCRIPTION OF THE DRAWING

The present invention will become readily understood from the following description taken in conjunction with a preferred embodiment thereof with reference to the accompanying drawings, in which.

DETAILED DESCRIPTION OF THE INVENTION

Figure 1:
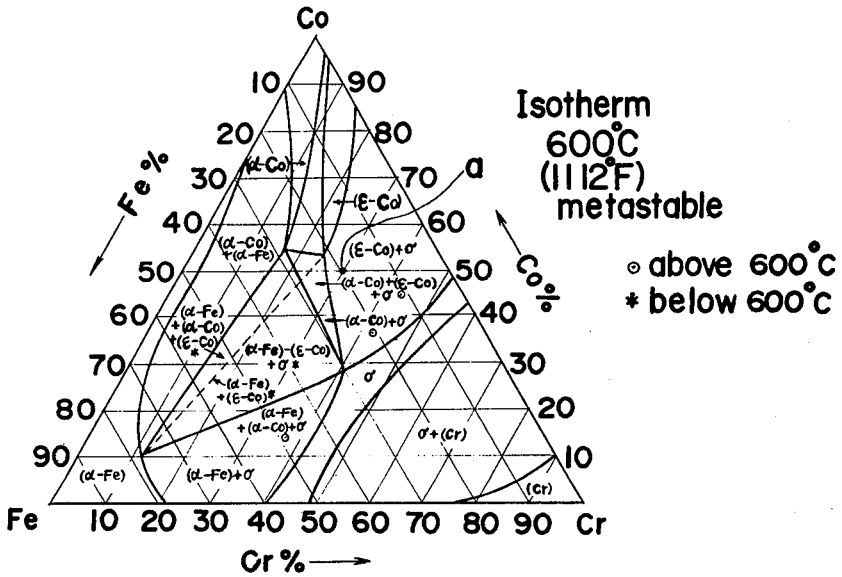
FIG. 1 is an equilibrium diagram of alloyed steels containing iron, chromium and cobalt.

According to the present invention, the heat resisting alloyed steel suited as a material for the rails or like guides and capable of exhibiting a high compressive strength at the elevated temperature within the range of 1,250° to 1,300° C. contains carbon in an amount of not more than 0.15%, preferably 0.10 to 0.14%; silicon in an amount of 1 to 2%, preferably 1.0 to 1.8%; chromium in an amount of 25 to 32%, preferably 26.1 to 29.4%; manganese in an amount of 1 to 2%, preferably 1.1 to 1.8%; nickel in an amount of 10 to 25%, preferably 15.2 to 24.5%; cobalt in an amount of 25 to 45%, preferably 38.4 to 45.1%, molybdenum in an amount of 0.3 to 10%, preferably 3.4 to 8.0%; phosphorus in an amount of not more than 0.04%, preferably 0.02 to 0.03%; sulfur in an amount of not more than 0.04% preferably 0.024 to 0.029%; niobium in an amount of 0 to 3%, preferably 0.3 to 3%; and iron as a remainder, said percentage being based on the total weight of the composition.

Hereinafter, the reason for the uppermost and lowermost limits of the amount of each of the elements constituting the composition of the alloyed steel according to the present invention will now be described.

As regards carbon, it acts to improve the physical strength of the alloyed steel. However, if it is employed in an amount in excess of 0.15 wt%, the melting point of the resultant alloyed steel will adversely be affected.

As regards silicon, it acts to improve the resistance to elevated temperature of the alloyed steel and, in order to achieve this, the amount of silicon to be employed should be in excess of 1 wt%. However, if it is employed in an amount in excess of 2 wt%, the toughness of the resultant alloyed steel will adversely be affected.

As regards manganese, it acts to stabilize the austenite structure and concurrently to fix sulfur contained in the alloyed steel if employed in an amount not less than at least 1 wt%. However, if it is employed in an amount in excess of 2 wt%, waste will result. In other words, the employment of this element in an amount of 1 to 2 wt% is sufficient to achieve the above described objects simultaneously.

As regards chromium, it is an important element to ensure improvement in resistance to elevated temperature. If this element is employed in an amount not more than 25 wt%, the resultant alloyed steel will not exhibit a sufficient resistance to the temperature within the range of 1,250° to 1,300° C. and, on the other hand, if it is employed in an amount in excess of 32 wt%, the toughness and castability of the resultant alloyed steel will adversely be affected.

As regards nickel, this element acts to stabilize the austenite structure and, in order to achieve this, the amount thereof should be not less than 10 wt%. If the amount of this element to be employed exceeds 25 wt%, no more improvement will be expected.

As regards cobalt, this is an important element to ensure a high compressive strength at elevated temperature. In order to impart a desired compressive strength at the temperature within the range of 1,250° to 1,300° C., the employment of this element in an amount at least 25 wt% is required. However, the amount thereof in excess of 45 wt% will adversely affect the heat resistance of the resultant alloyed steel.

As regards molybdeum, this is also an important element to improve the compressive strength of the resultant alloyed steel at the elevated temperature and, in order to achieve this, the amount of this element to be employed should not be less than 0.3 wt%. However, if this element is employed in an amount in excess of 10 wt%, the heat resistance of the resultant alloyed steel will adversely be affected.

As regards niobium, this is an effective element to improve the compressive strength of the resultant alloyed steel at the elevated temperature and this is achieved more effectively when used with tungsten than without tungsten. Although this element may not be employed, the employment of this element in an amount nor more than 3wt% is preferred. If the amount exceeds 3 wt%, the resistance to oxidation of the resultant alloyed steel will adversely be affected.

As regards phosphorus and sulfur, these elements constitute impurities in the resultant alloyed steel and, therefore, if the amount of each of these element is in excess of 0.04 wt%, the physical strength of the resultant alloyed steel will adversely affected.

The present invention will now be described by way of examples which are not intended to limit the scope of the present invention.

EXAMPLES

Figure 2:
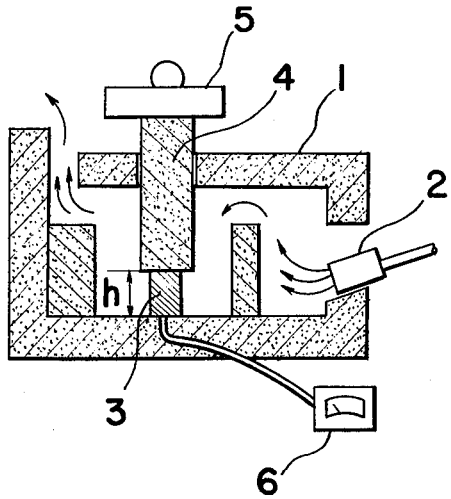
FIG. 2 is a sectional view of a test furnace used to measure the compressive strength of the alloyed steel of the present invention.

Specimens of alloyed steel according to the present invention, which have different compositions as identified by I, II, III and IV in the following table, were tested to measure the compressive strength at elevated temperature by the use of a test furnace constructed as shown in FIG. 2.

Referring to FIG. 2, the test furnace, generally indicated by 1, has an oxygen-propane burner 2 for heating the interior of the test furnace 1. Each of the specimens having a height *h* were placed on the bottom of the interior of the test furnace and held in place between the interior bottom and a load applying device, which load applying device includes a weight transmitter 4 and a weight 5. Each of the specimens was heated within the test furnace 1 to a temperature of 1,300° C, as measured by a thermocouple 6, by the burner 2 so positioned that a flame from the burner 2 does not directly contact the specimen being tested. The load applied to the specimens was 0.5 kg/mm$^2$.

A specimen of 30%Cr-50%Co-Fe alloyed steel was tested in the same condition for the purpose of comparision.

The results are tabulated in the following table. However, it should be noted that the compressive strength is expressed in terms of the velocity of deformation which is expressed by percent per hour, calculated by the following formula:

$$\text{Deformation Velocity (\%/hr.)} = \frac{h - h'}{h \times a} \times 100$$

wherein $h'$ represents the height of the specimen after the latter has been tested, that is, after the latter has been compressed heightwise by the application of the load, and $a$ represents the time during which the load is applied.

TABLE

| | | INVENTION (as cast) | | | | |
|---|---|---|---|---|---|---|
| | | I | II | III | IV | COMP. |
| C | | 0.10 | 0.12 | 0.10 | 0.14 | 0.10 |
| Si | | 1.5 | 1.0 | 1.2 | 1.8 | 0.90 |
| AMOUNT (wt %) Reminder: Fe | Mn | 1.4 | 1.5 | 1.1 | 1.8 | 1.0 |
| | P | 0.020 | 0.024 | 0.026 | 0.030 | 0.025 |
| | S | 0.024 | 0.026 | 0.028 | 0.029 | 0.030 |
| | Cr | 28.3 | 25.1 | 29.4 | 26.1 | 30 |
| | Mo | 5.0 | 8.0 | 5.2 | 3.4 | — |
| | Ni | 20.9 | 24.5 | 23.0 | 15.2 | — |
| | Co | 41.8 | 45.1 | 43.5 | 38.4 | 49.8 |
| COMPRESSIVE STRENGTH AT 1,300° C. (%/hr.) | | 0.234 | 0.226 | 0.267 | 0.253 | 0.342 |
| HARDNESS (BHN) | | 249 | 253 | 248 | 250 | 253 |

From the table above, it is clear that the alloyed steel according to the present invention, when the velocity of deformation occurring per hour at 1,300° C. is taken into consideration, has a higher resistance to pressure than that of the known 30%Cr-50%Co-Fe steel.

It is also clear that the alloyed steel according to the present invention has, even in the form as cast, a sufficient hardness comparable with the known steel.

Not only the above features reside in the alloyed steel of the present invention, but also the alloyed steel according to the present invention has additional features with respect to an improvement in resistance to oxidation and castability.

Therefore, the alloyed steel according to the present invention has a wide application and, for example, can also be used as a material for rails or similar guides within a furnace and supports for support of silicon containing steel to be heat-treated.

Although the present invention has been fully described by way of example, it should be noted that various changes and modifications are apparent to those skilled in the art, it being understood that such changes and modifications should be construed as included therein unless they depart therefrom.

What is claimed is:

1. A heat resisting alloy having a high compressive strength at elevated temperature which consists essentially of carbon in an amount of not more than 0.15%, silicon in an amount of 1 to 2%, chromium in an amount of 25 to 32%, manganese in an amount of 1 to 2, nickel in an amount of 10 to 25%, cobalt in an amount of 25 to 45%, molybdenum in an amount of 0.3 to 10%, phosphorus in an amount of not more than 0.04%, sulfur in an amount of not more than 0.04%, niobium in an amount of 0 to 3%, and iron as the remainder, said percentage being based on the total weight of the composition.

2. A heat resisting alloy having a high compressive strength at elevated temperature which consists essentially of carbon in an amount of 0.10 to 0.14%, chromium in an amount of 26.1 to 29.4%, silicon in an amount of 1.0 to 1.8%, manganese in an amount of 1.1 to 1.8%, nickel in an amount of 15.2 to 24.5%, cobalt in an amount of 38.4 to 45.1%, molybdenum in an amount of 0.5 to 8.0%, phosphorus in an amount of 0.02 to 0.03%, sulfur in an amount of 0.024 to 0.029%, niobium in an amount of 0.3 to 3%, and iron as the remainder, said percentage being based on the total weight of the composition.

* * * * *